US005556297A

United States Patent [19]

Bray et al.

[11] Patent Number: 5,556,297

[45] Date of Patent: Sep. 17, 1996

[54] SNAP-ON EXTENSION WIRE SOCKET WITH ELECTRICAL CONDUCTOR INSULATION PIERCER

[75] Inventors: Douglas R. Bray, Medford, N.J.; Michael M. Strazhnik, Philadelphia, Pa.

[73] Assignee: Sea Gull Lighting, Riverside, N.J.

[21] Appl. No.: 332,021

[22] Filed: Oct. 31, 1994

[51] Int. Cl.[6] ..... H01R 4/24

[52] U.S. Cl. ..... 439/405; 439/460; 439/638

[58] Field of Search ..... 439/402–404, 439/419, 638, 452, 460, 426

[56] References Cited

U.S. PATENT DOCUMENTS

| | | | |
|---|---|---|---|
| D. 344,262 | 2/1994 | Bray | D13/134 |
| 2,779,842 | 1/1957 | Walker . | |
| 4,159,157 | 6/1979 | Koehler | 339/97 |
| 4,855,882 | 8/1989 | Boss | 362/238 |
| 4,988,311 | 1/1991 | Tanzola | 439/404 |
| 5,045,981 | 9/1991 | Nagano | 362/219 |
| 5,141,449 | 8/1992 | Tieszen | 439/419 |
| 5,199,899 | 4/1993 | Ittah | 439/403 |
| 5,280,417 | 1/1994 | Hall et al. | 362/226 |
| 5,321,592 | 6/1994 | Marinacci | 439/419 |

FOREIGN PATENT DOCUMENTS

| | | | |
|---|---|---|---|
| 1030105 | 5/1966 | United Kingdom | 439/419 |

OTHER PUBLICATIONS

AMBIANCE Landscape Lighting System catalog, Supplement No. AMB–93 LC, Sea Gull Lighting Products, Inc., Riverside, NJ, 1993, pp. 18–19.

Sea Gull Lighting Products, Inc. 1993 catalog, Riverside, NJ, 1993, pp. 59, 164 and 165.

*Primary Examiner*—P. Austin Bradley
*Assistant Examiner*—Jill DeMello
*Attorney, Agent, or Firm*—Seidel, Gonda, Lavorgna & Monaco

[57] ABSTRACT

An extension wire socket includes a nonconductive U-shaped portion, a nonconductive chamber and at least one electrical connector supported therein. The U-shaped portion is defined by a base and opposed tabs extending from the base. The U-shaped portion snaps over insulated electrical conductors. The nonconductive chamber is adjacent to the base. The socket accepts the terminal end of an extension wire. Each connector includes a spiked prong for piercing the insulation of one of the conductors when the socket is attached to the conductors. Each connector also includes an insulation displacement terminal for attaching the terminal end of the extension wire thereto. The spiked prong is located in the U-shaped portion and the insulation displacement terminal is located in the chamber. The connector is slotted into the socket in a manner that protects most portions of it from exposure and unwanted flexing and stresses.

13 Claims, 8 Drawing Sheets

FIG. 1
(PRIOR ART)
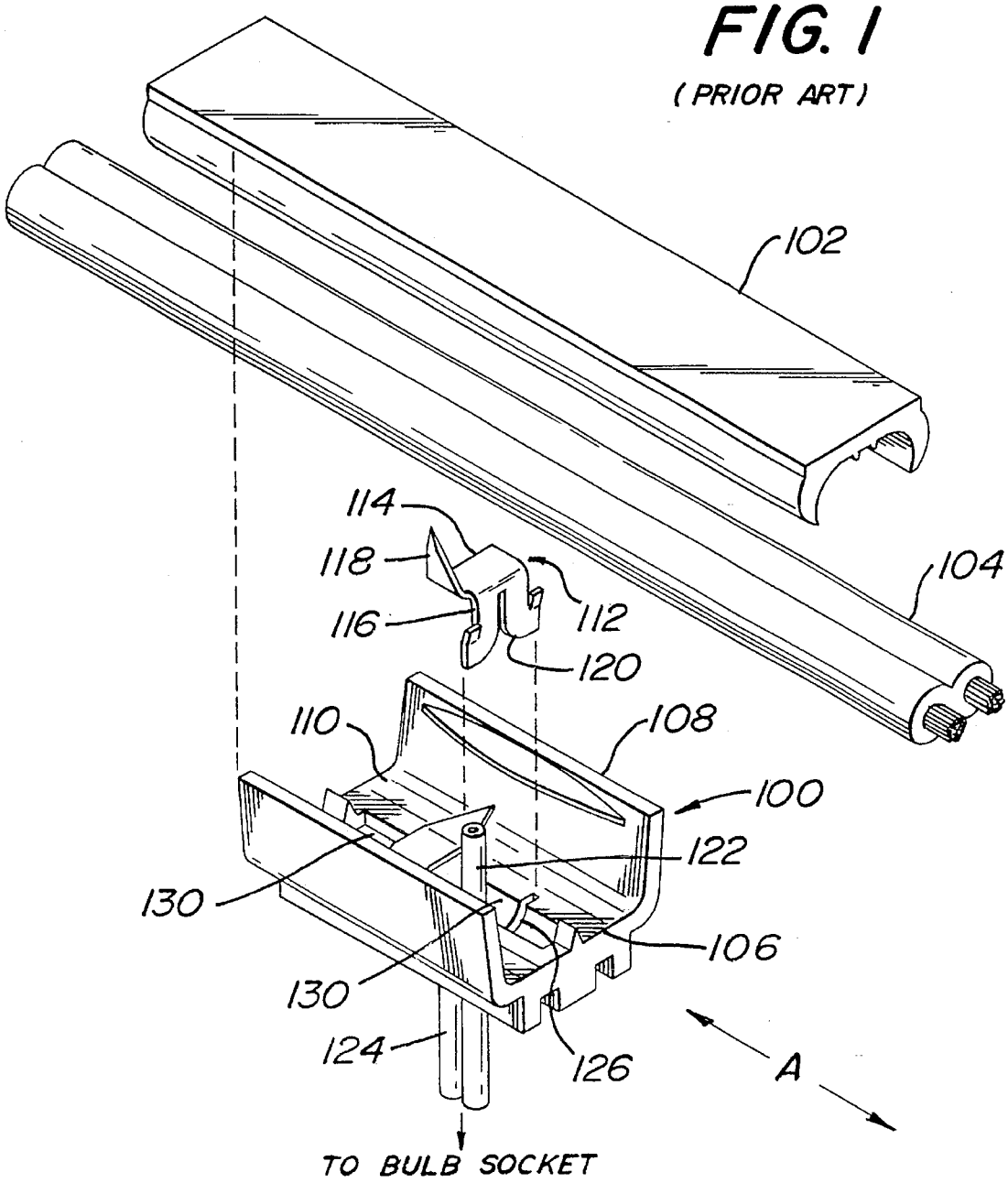
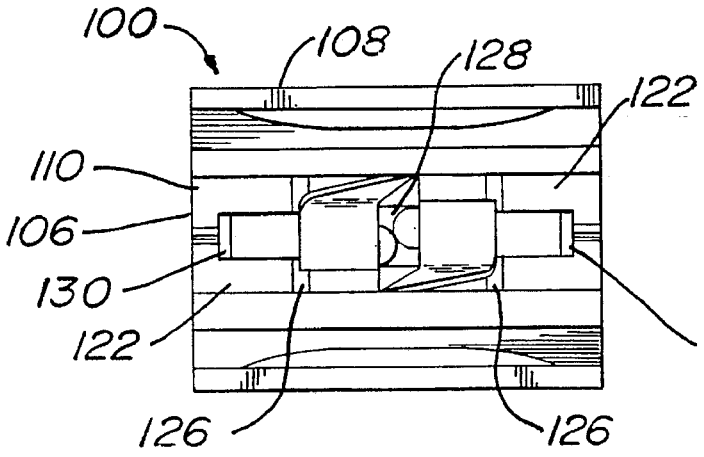
FIG. 2
(PRIOR ART)

FIG. 3
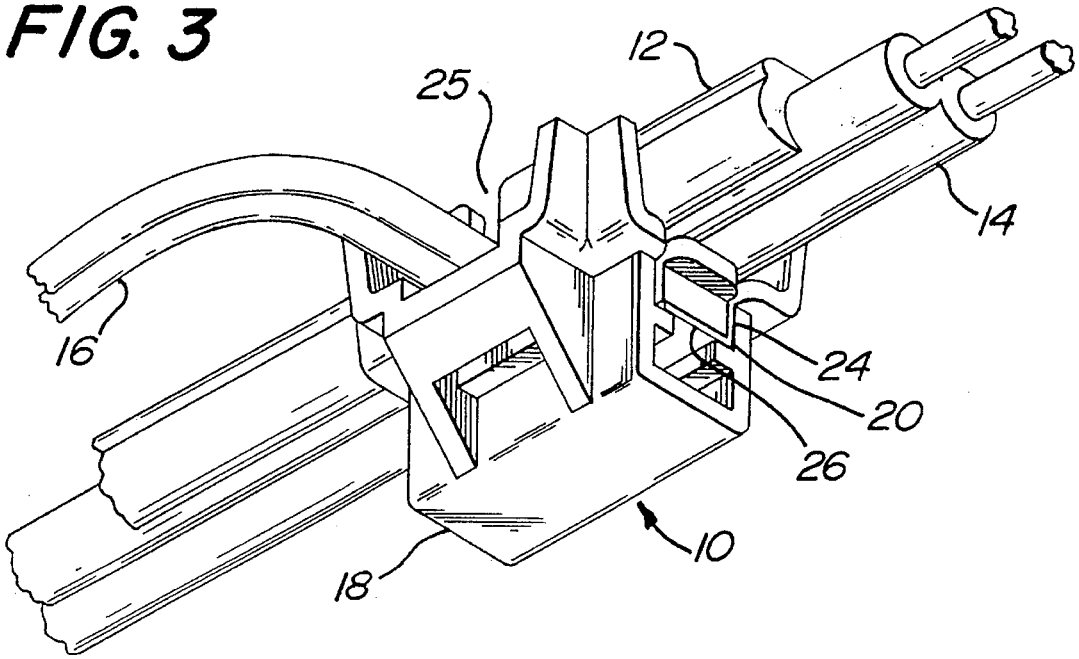
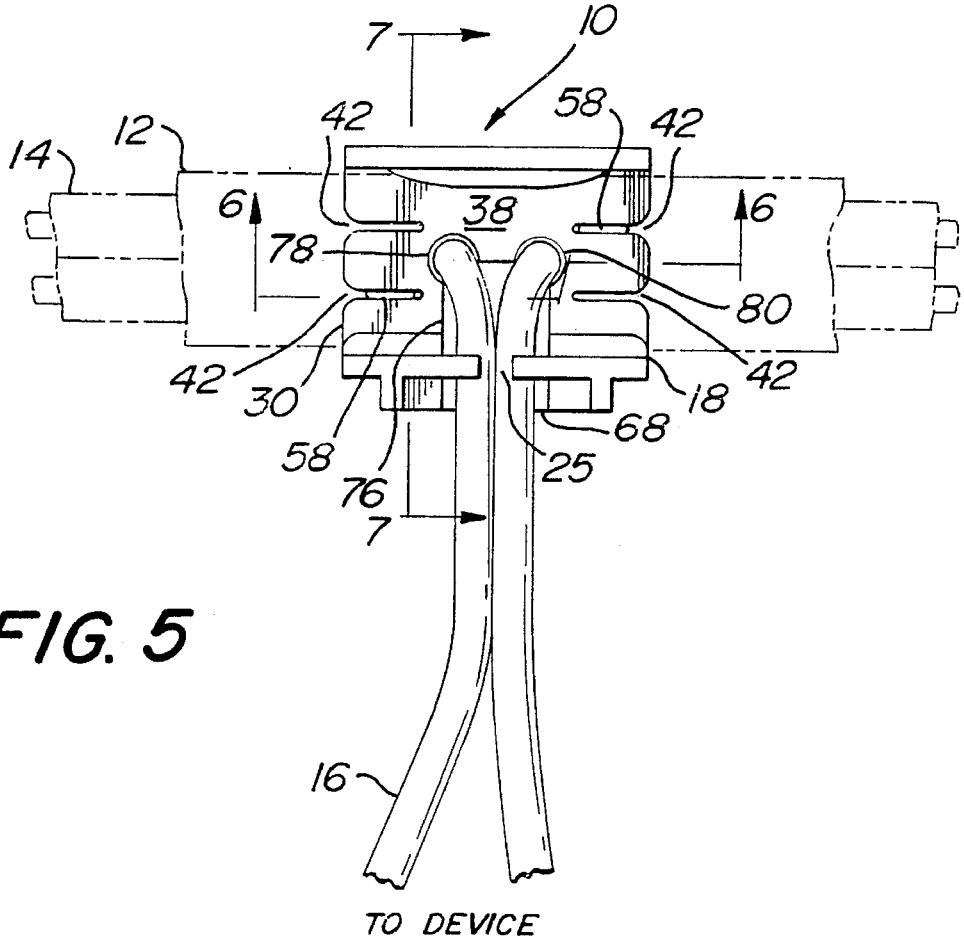
FIG. 5

SNAP-ON EXTENSION WIRE SOCKET WITH ELECTRICAL CONDUCTOR INSULATION PIERCER

FIELD OF THE INVENTION

This invention relates to an extension wire socket which makes electrical connection to insulated electrical conductors through spiked prongs, and more particularly to a snap-on type socket for attachment to a channel holding a pair of the electrical conductors.

BACKGROUND OF THE INVENTION

Snap-on type electrical connectors which make electrical connection to insulated electrical conductors through spiked prongs are known in the art. FIGS. 1 and 2 show one form of such a prior art connector assembly for electrically connecting a pair of electrical wires from a light fixture to a pair of electrical conductors. FIG. 1 shows an exploded view of the connector assembly, electrical conductors, and attachment mechanism. FIG. 2 shows a bottom view of a fully assembled version of the connector assembly. For clarity, FIG. 1 and 2 are described together.

The connector assembly includes a nonconductive elongated U-shaped or channel-shaped housing 100 which snaps onto a channel 102 partially surrounding a pair of insulated electrical conductors 104. The conductors 104 carry electrical current. The housing 102 has a central longitudinal axis A and is defined by a base 106 and two sidewalls 108. The housing sidewalls 108 snap onto the channel 102. The base 106 includes an interior surface 110 which faces the conductors 104. Two electrical connectors 112 are attached to the housing 100 by slotting a portion of each of the connectors 112 into the housing base 106, as further described below.

Each electrical connector 112 is a unitary conductive piece including a base portion 114, a terminal portion 116 and a spiked prong 118. The spiked prong 118 extends perpendicularly upward from a side edge of the base portion 114. When the connector 112 is inserted into the housing 100, the spiked prong 118 extends from the connector 112 into the open interior space of the channel-shaped housing 100. The prong 118 is oriented so that it aligns with one of the two insulated electrical conductors 104 when the housing 100 is snapped over the channel 102 surrounding the conductors 104, each prong 118 aligning with a respective one of the conductors 104. The terminal portion 116 includes insulation displacement terminal 120 for attaching terminal end 122 of one of a pair of electrical wires 124 thereto by insulation displacement, or the like. The other end of the electrical wire 124 connects to one end of the bulb socket of the light fixture (not shown).

When the housing 100 of a fully assembled connector assembly is snapped over the channel 102, each of the spiked prongs 118 pierces the insulation of a respective conductor 104 and becomes embedded therein. This causes the connector 112, and thus the light fixture bulb socket, to be in electrical contact with the conductors 104.

As noted above, the electrical connectors 112 are attached to the housing 100 by slotting a portion of each of the connectors 112 (i.e., the terminal portion 116) into the housing base 106. Accordingly, the base 106 includes two slots 126 extending therein, each slot 126 receiving the terminal portion 116 of one of the connectors 112. The slots 126 are oriented perpendicular to the longitudinal axis A.

The housing base 106 also includes opening 128 for allowing the terminal ends 122 of the pair of electrical wires 124 from the light fixture to pass therethrough and into the open interior space of the housing 100. The opening 128 is formed in a central region of the base 106. The interior surface 110 of the housing base 106 includes a recess 130 along the central longitudinal axis A of the housing. The terminal ends 122 of the pair of electrical wires 124 lie in the recess 130, as best shown in prior art FIG. 2, one terminal end 122 lying in a leftmost portion of the recess 130 and the other terminal end 122 lying in a rightmost portion of the recess 130.

In the prior art connector assembly shown in FIGS. 1 and 2, the base portion 114 of the connector 112 is exposed to the interior surface 110 of the housing 100. Also, since three side edges of the base portion 114 are not braced against any structure, the base portion 114 and the prong 118 attached thereto are not securely held in place. Furthermore, since the base portion 114 overlies the terminal end 122 of one of the electrical wire 44, the base portion 114 cannot lie perfectly flush against the interior surface 110. These factors potentially weaken the strength of the connector assembly and reduce the ability of the connector 112 to remain firmly in position during and after attachment to the electrical conductors 104.

There is still a need for a snap-on socket for connecting wiring to electrical conductors by connectors having spiked prongs which provide a secure and firm connection between the connectors and the wiring. The present invention fills that need.

SUMMARY OF THE INVENTION

The present invention provides an extension wire socket for attachment to insulated electrical conductors. The socket accepts at least one terminal end of at least one extension wire. The socket comprises a nonconductive housing and at least one electrical connector supported by the housing. The nonconductive housing includes a U-shaped portion and a chamber. The U-shaped portion is defined by a base and opposed tabs extending from the base. The U-shaped portion is dimensioned to surround the conductors. The chamber is adjacent to the base of the U-shaped portion. The electrical connector electrically connects the terminal end of the extension wire to one of the conductors. Each connector includes a first portion having a spiked prong associated therewith for piercing the insulation of one of said conductors when the socket is attached to the conductors and making conductive contact with the conductor. The spiked prong is located in the U-shaped portion. Each connector also includes a second portion attached to the first portion. The second portion has an insulation displacement terminal associated therewith for attachment to the terminal end of the extension wire. The insulation displacement terminal is located in the chamber.

In one embodiment, the inventive socket electrically attaches a plug-in outlet to insulated electrical conductors.

BRIEF DESCRIPTION OF THE DRAWINGS

For the purpose of illustrating the invention, there is shown in the drawings a from which is presently preferred; it being understood, however, that this invention is not limited to the precise arrangements and instrumentalities shown.

FIG. 1 is a perspective view of a prior art connector assembly.

FIG. 2 is a bottom view of the connector assembly in FIG. 1.

FIG. 3 is perspective view of one preferred form of a socket in accordance with the present invention shown mounted on an electrical conductor channel with extension wires attached thereto.

FIG. 5 is a bottom view of the socket in FIG. 3, showing the channel and electrical conductors in phantom.

DESCRIPTION OF THE PREFERRED EMBODIMENT

Figure 4:
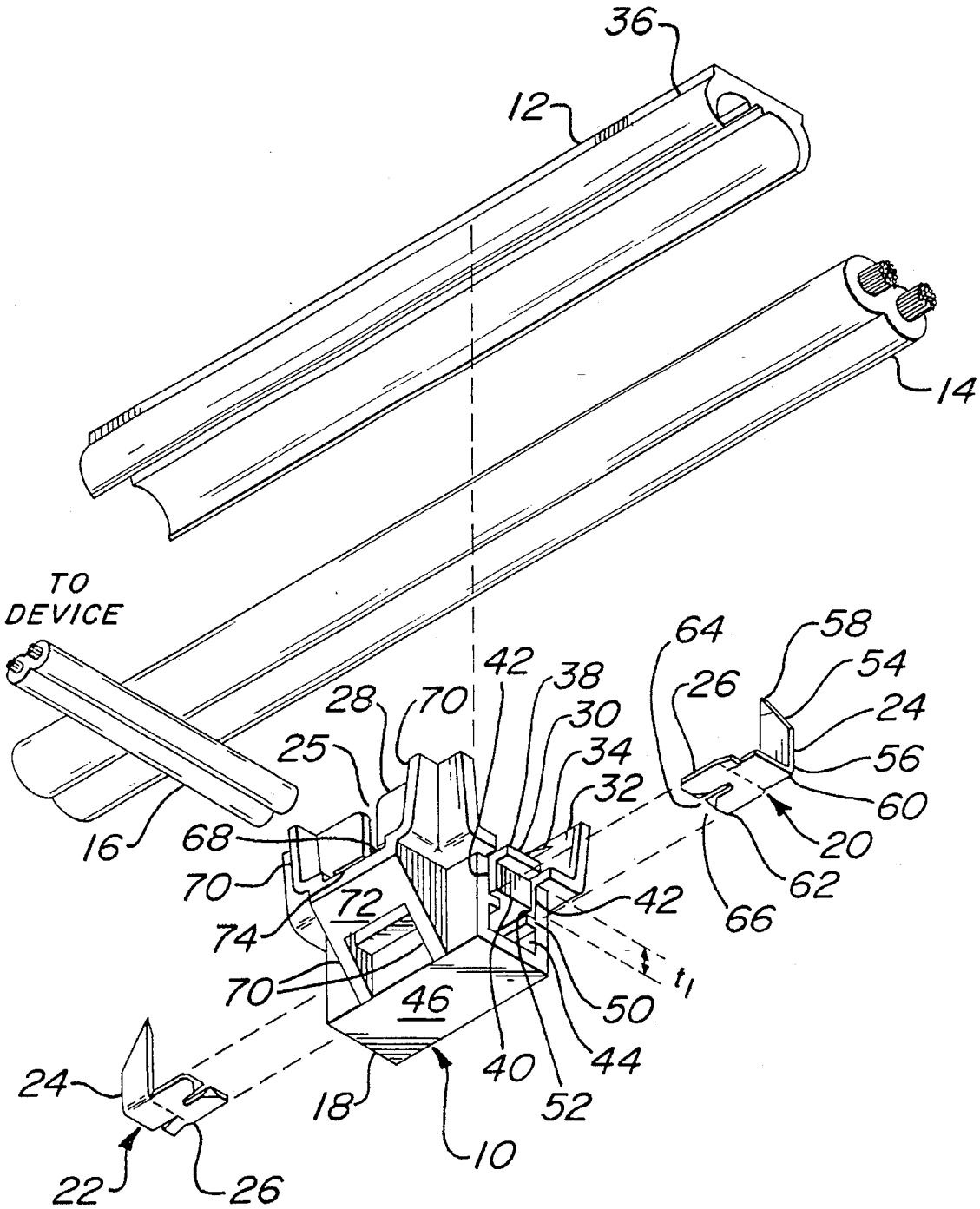
FIG. 4 is an exploded view of the socket in FIG. 3.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Certain terminology is used herein for convenience only and is not be taken as a limitation on the invention. Particularly, words such as "upper," "lower," "left," "right," "horizontal," "vertical," and "upward" merely describe the configuration shown in the figures. Indeed, the socket and electrical conductors may be oriented in any direction.

Apparatus depicting the preferred embodiment of the novel socket is illustrated in the drawings.

Figure 6:
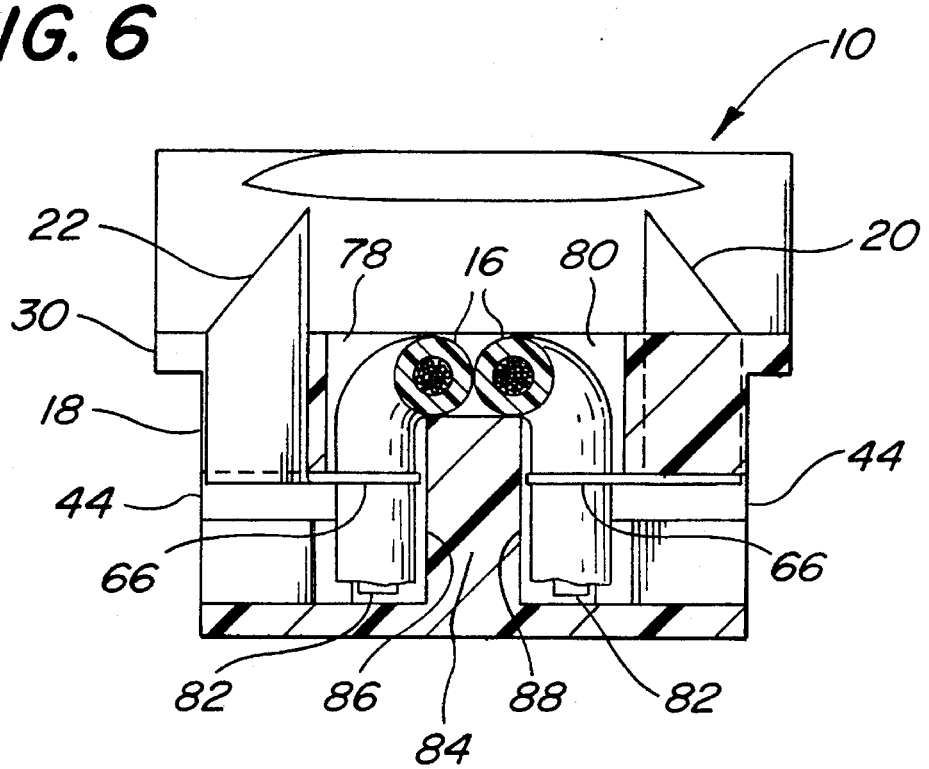
FIG. 6 is a sectional view of the socket in FIG. 3, taken along line 6—6 in FIG. 5.
Figure 7:
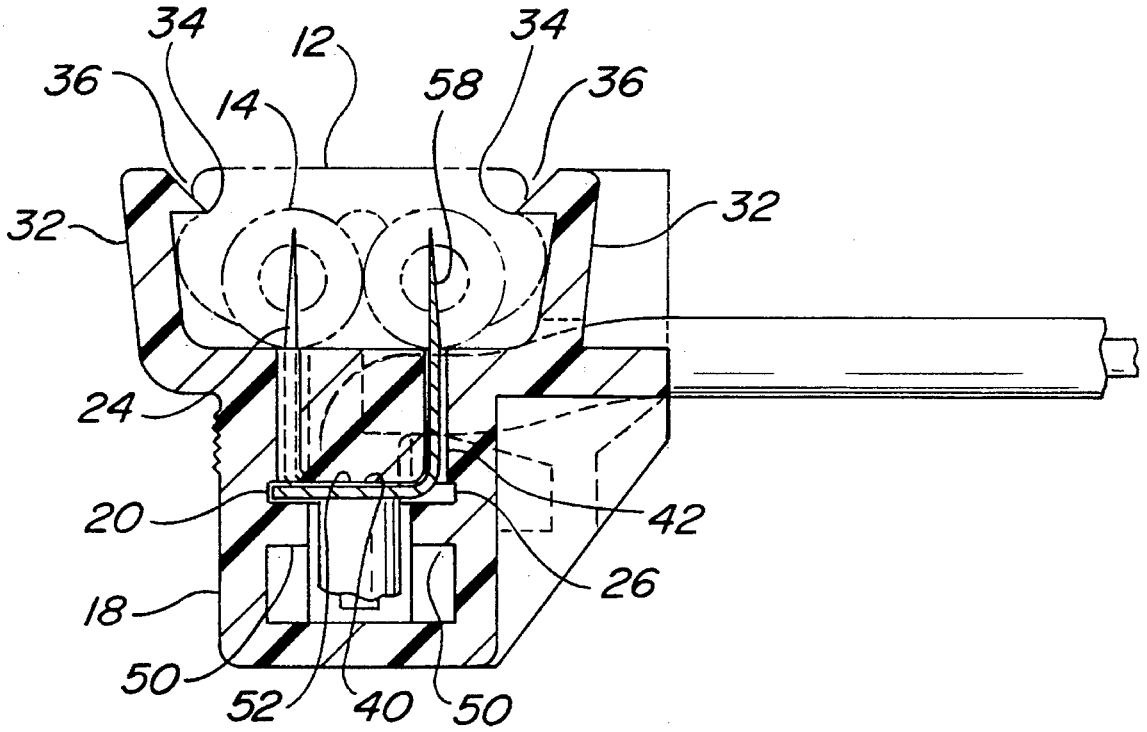
FIG. 7 is sectional view of the socket in FIG. 3, taken along line 7—7 of FIG. 5, also showing the channel and electrical conductors in phantom.
Figure 8:
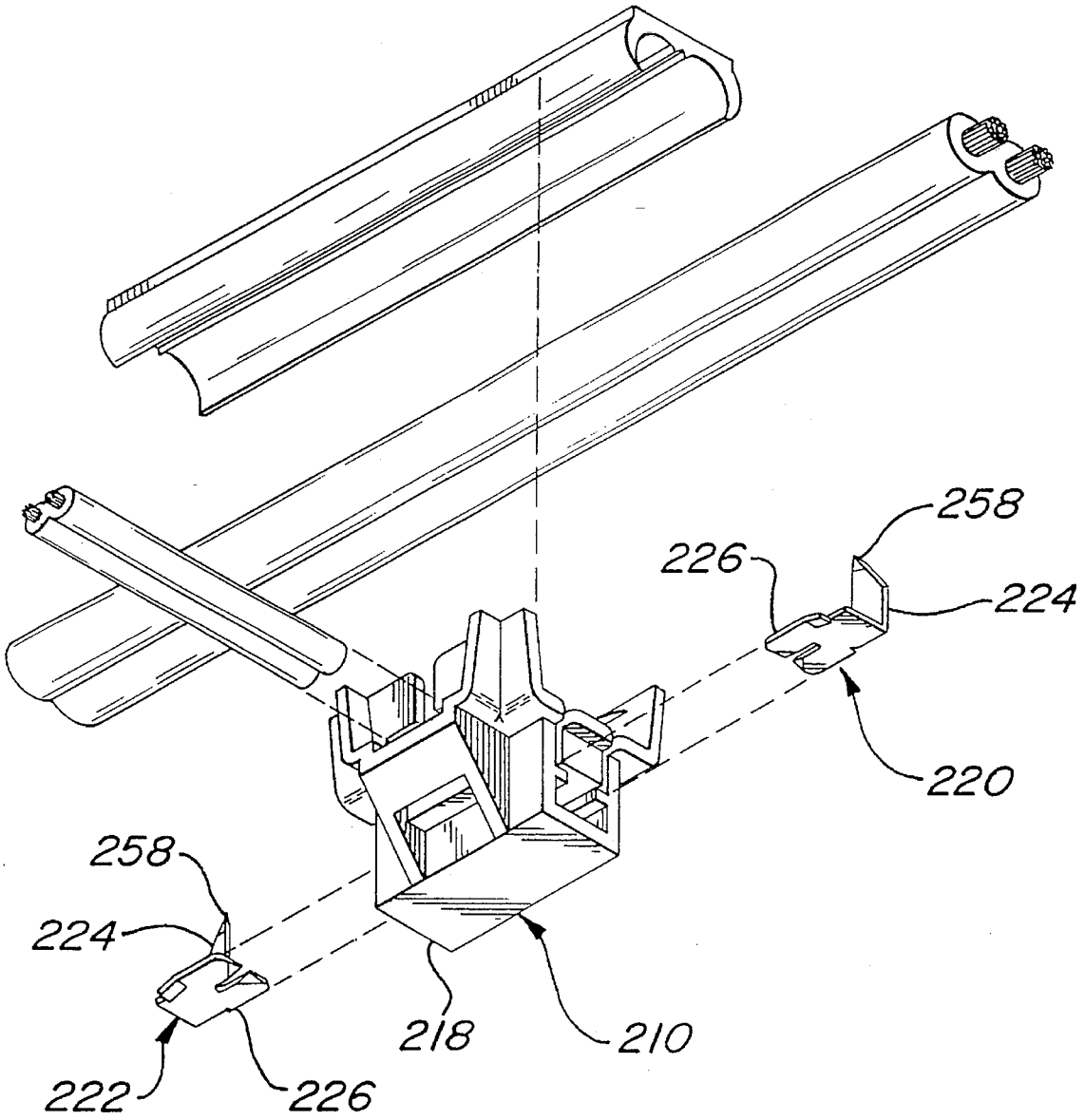
FIG. 8 is an exploded view of an alternative embodiment of the socket in FIGS. 3 and 4.

Turning first to FIG. 3, a socket 10 is shown mounted on channel which surrounds electrical conductors 14. Extension wires 16 feed into the socket 10 and are attached thereto, as best shown in FIGS. 6 and 7. The socket includes a nonconductive housing 18 which carries either one or two electrical connectors. The embodiment disclosed herein houses two connectors 20 and 22. In FIG. 3, however, only connector 20 is visible. Each connector 20, 22 includes a first portion 24 which is slotted vertically into the housing 18 and terminates at a spiked prong (not shown), and a second portion 26 which is slotted horizontally into the socket housing 18. The spiked prong is embedded in the wiring of the conductors 14 when the socket 10 is fully attached to the channel 12. The housing 18 also includes a sidewall slot 25 for facilitating insertion and removal of the extension wires 16.

FIG. 4 shows an exploded view of FIG. 1 and more clearly illustrates the parts of the socket 10 and how it attaches to the channel 12 and the conductors 14.

The socket's housing 18 has an elongated U-shaped or channel-shaped portion 28. The U-shaped portion 28 has a generally rectangular base 30 (best shown in FIG. 5) and opposed tabs or sidewalls 32 extending outward and upward (as oriented in FIG. 4) from edges of the base 30. The far ends of the tabs 32 include short inwardly facing projections 34 (best shown in FIG. 7) which lock the tabs 32 into grooves 36 on either side of the channel 12. Only a portion of one projection 34 is visible in FIG. 4. Likewise, only one groove 36 is visible in this view. The base 30 thickness $t_1$ is relatively large (compared to the thickness of the tabs 32) to allow the base 30 to house and brace part of the first portion 24 of the electrical connectors 20 and 22, as described below. The base 30 has an upper surface 38 adjacent and facing the electrical conductors 14, and a lower surface 40.

The sidewall slot 25 is disposed along a mid-section of the front facing tab 32. The slot 25 is only disposed on the side of the housing 18 where the extension wires 16 enter. The slot 25 facilitates installation and removal of the wires 16. The slot width is slightly larger than the width of one extension wire 16, thereby allowing one wire 16 to pass therethrough, but smaller than the width of two extension wires 16, thereby preventing a pair of installed extension wires 16 from slipping out of position.

Vertical slots 42 extend perpendicularly through the entire thickness $t_1$ of the base 30 (i.e., from the upper surface 38 to the lower surface 40). Four such vertical slots 42 are formed in the base 30 of the disclosed embodiment, one near each of the base corners. Two of the vertical slots 42 are visible in FIG. 4. As noted above, the vertical slots 42 receive the first portion 24 of the connectors 20, 22. FIG. 5 best illustrates the upper surface 38 and the four vertical slots 42 therein.

The housing 18 further includes an elongated chamber 44 adjacent and generally parallel to the lower surface 40 of the base 30. The chamber 44 is defined by nonconductive chamber base 46 and nonconductive outer sidewalls 48 which extend perpendicularly from edges of the base 46, towards the U-shaped portion 28. The outer sidewalls 48 smoothly merge into the outer edges of the base lower surface 40. One such sidewall 48 is visible in FIG. 4. As defined herein, the sidewall 48 includes only the portion of the socket's outer surface below the dashed line. The portion of this surface above the dashed line includes the outer surface of the base 30 and the tabs 32. Ribs 50 extend a short distance into the chamber 44 from either sidewall 48. The ribs 50 lie in a plane which is generally perpendicular to the plane of the sidewalls 48. The ribs 50 are spaced a short distance from the base lower surface 40 so as to form horizontal slots 52 therebetween for receiving the second portion 26 of the electrical connector 20 or 22.

FIG. 4 shows the electrical connectors 20, 22 apart from the socket 10. As described above, each connector 20, 22 includes a first portion 24 and a second portion 26. Turning first to connector 20, the first portion 24 has a distal end 54 and a proximal end 56. A spiked prong 58 extends from the distal end 54. The second portion 26 has a proximal end 60 and a distal end 62. A cut-out 64 in the distal end 62 forms an insulation displacement terminal 66 thereon. The first and second portions 24 and 26 each lie in a plane, the planes being perpendicular to each other. The first portion 24 attaches to the second portion 26 along a right side edge of the proximal end 60 of the second portion 26, in an L-shape.

In the view of FIG. 4, the connector 22 appears as a forward L-shape and the connector 24 appears as a backward L-shape. Connector 20 is actually identical to connector 22. The connector 20 is merely the connector 22 rotated 180 degrees about a horizontal axis.

FIG. 4 also shows the extension wires 16 feeding into the socket housing 18 through an opening 68. The path of the wires 16 inside the socket housing 18 is best described with respect to FIGS. 5–7.

The socket 10 further includes optional extension ribs 70 which project outward from one of the sidewalls 48 and from an outer surface of one of the tabs 32. The extension ribs 70 which project outward from the sidewall 48 are bridged by a planar surface 72. The horizontal plane of an upper edge 74 of this surface 72 aligns with the horizontal plane of a lower edge of the opening 68. The surface 72 provides a support ledge for the extension wires 16 and functions to inhibit flexing of the portion of the wires 16 in and near the socket housing 18.

When it is desired to attach a socket 10 to an electrical conductor/channel subassembly, the socket 10 is first assembled and then snapped onto the subassembly. To assemble a socket 10, one or two extension wires 16 are fully inserted into an empty socket housing 18. The terminal end of each extension wire 16 is fed through the opening 68. A terminal region of the extension wire 16 is then bent at a right angle to allow the terminal end to be pushed into a hole through the base 30 (described in more detail below) and into the chamber 44 until the terminal end of the extension wire 16 reaches the inner surface of the chamber base 46. Next, a connector 20 or 22 is partially inserted into the horizontal and vertical slots 42 and 52 of the socket housing 18. The connector 20 or 22 is further pushed into the vertical and horizontal slots 42 and 52 until the cut-out 64 of the connector's insulation displacement terminal 66 becomes pushed into a portion of the extension wire inside the chamber 44, near the wire's terminal end. As this occurs, the terminal 66 severs the wire insulation and makes electrical contact with the wire. The chamber 44 and the second portion 26 of the electrical connector 20 or 22 are dimensioned so that the proximal end 60 of the second portion 26 lies approximately flush against the chamber opening when the connector is fully inserted into the chamber 44.

If a second extension wire is employed, the procedure is duplicated by inserting the second wire into another hole through the base and into a different region of the chamber 44 having a structure similar to the region shown in FIG. 4. A second connector is then inserted into the opposite side of the socket housing 18 to make electrical connection with that wire.

FIG. 5 is a bottom view of the socket 10 and shows the channel 12 and the electrical conductors 14 in phantom. FIG. 5 best illustrates the upper surface 38 of the U-shaped portion's rectangular base 30 and the four vertical slots 42 therein. In a bottom view of a fully attached socket 10, the conductors 14 overlie the upper surface 38 and the channel 12 overlies the conductors 14. The slot 25 is also shown more clearly in this view.

In FIG. 5, two of the four vertical slots 42 are occupied by connectors. The upper right hand vertical slot 42 holds connector 20 and the lower left hand vertical slot 42 holds connector 22. The spiked prongs 58 of those connectors are visible in this view. The socket housing 18 is designed to hold a maximum of two connectors, one in each side of the base 30. If a connector is inserted into the lower left hand vertical slot 42, then the upper left hand slot is not used, and vice versa. Likewise, if a connector is inserted into the upper right hand vertical slot 42, then the lower right hand slot is not used, and vice versa.

The four slot socket housing 18 allows for a variety of different connector arrangements. In one arrangement, only a single connector is employed in one of the four vertical slots 42. This arrangement is preferred when the connector is employed solely to tap into a hot lead of the electrical conductors 14. Obviously, in such an arrangement, the device connected to the hot lead is grounded through a path other than the ground lead of the electrical conductor 14. In another arrangement, as shown in FIGS. 3–7, two identical connectors are employed. One connector is inserted into the upper left hand or right hand vertical slot and the other connector is inserted into the lower right hand vertical slot or upper left hand vertical slot, respectively. That is, the connectors are placed in diagonally opposite vertical slots. In this arrangement, each connector becomes electrically connected to a different one of the conductors 14 when the socket 10 is snapped into place, in a manner similar to prior art FIGS. 1 and 2. This arrangement allows the socket 10 to function as an extension cord for a single device, delivering both the hot and ground wires to the device.

In yet another arrangement as shown in FIGS. 8–11 and described more fully hereinafter, the extension wire socket is connected to a switch. One connector is inserted into one of the left hand vertical slots and the other connector is inserted into the right hand vertical slot on the direct opposite side. In this two connector arrangement, each connector makes electrical contact with the same conductor 14, albeit at different locations thereon. A nonconductive tab disposed between the spiked prongs 58 of the two connectors electrically separates or isolates the conductor portions attached to the first connector from the conductor portion attached to the second connector. Each extension wire is then connected to a respective side of a switch.

In yet another arrangement (not shown) one connector is inserted into one of the left hand vertical slots and the other connector is inserted into the right hand vertical slot on the direct opposite side. This arrangement is similar to the single connector arrangement, except that the two connector arrangement allows two devices to be powered by the conductor 14. In this two connector arrangement, each connector makes electrical contact with the same conductor 14, albeit at different locations thereon in the same manner as the switch embodiment. However, there is no separating tab. Again, each device must be grounded through a path other than the ground lead of the electrical conductor 14.

The novel socket 10 is particularly suitable for use in a low voltage lighting system such as a 12 V linear lighting system, wherein the extension wires connect one or both of the power conductors 14 to one or more low voltage devices.

FIG. 5 also shows more clearly how the extension wires 16 feed into the socket housing 18 through the opening 68. The base upper surface 38 includes a recess 76 in a region extending from about a central region of the surface 38 to the edge of the surface 38 coincident with the opening 68. A central region of the base upper surface 38 also includes two openings or holes 78, 80 therethrough, the two holes 78, 80 also forming part of the recess 76. The portion of the extension wires 16 inside the socket housing 18 lies entirely in the recess 76. In this manner, the base upper surface 38 lies flush against the conductors 14 when the socket 10 is fully attached to a conductor/channel subassembly, thereby improving the stability of the attachment. If the extension wires 16 were not pressed into the base upper surface 38, the wires 16 would interfere with the ability to make this flush attachment.

After the extension wires 16 reach the holes 78, 80, they make a 90 degree bend and extend through the base 30 and into the chamber 44, as best shown in FIGS. 6 and 7.

FIG. 6 is a sectional view of the socket 10, taken along line 6—6 in FIG. 5. FIG. 6 shows the extension wires 16 entering through the base 30, into the chamber 44 and terminating at respective terminal ends 82. The chamber 44 is separated by a nonconductive dividing wall 84 into a left and right side. The dividing wall 84 electrically isolates the left side of the chamber 44 from the right side. The dividing wall 84 has outer edges 86 and 88. One extension wire 16 enters each of the chamber sides. The holes 78, 80 are positioned near the dividing wall outer edges 86, 88, respectively, so that as each wire 16 is inserted through its respective hole and pushed into the left or right chamber 44, the wire 16 becomes positioned against a dividing wall edge 86 or 88. The dividing wall 84 thus acts as a prop and support for the wires 16. This function becomes important when a connector 20 or 22 is inserted into the socket housing 18. As the cut-out 64 (not shown) of the insulation displacement terminal 66 is pushed into a portion of the extension wire 16 near its terminal end 82, the propping and support provided by the dividing wall 84 inhibits movement of the wire 16 from its inserted position.

FIG. 7 is sectional view of the socket 10, taken along line 7—7 of FIG. 5. The channel 12, electrical conductors 14 and spiked prong 58 of the electrical connector 22 are shown in phantom. FIG. 7 best illustrates the manner in which the tab projections 34 lock the tabs 32 into the grooves 36 of the channel 12. FIG. 7 also clearly shows how the first portion 24 and the second portion 26 of the electrical connector 20 fit inside the socket housing 18. The first portion 24 fits into one of the vertical slots 42 (the left slot in this view). The second portion 26 fits into a horizontal slot 52 between the chamber ribs 50 and the base lower surface 40. One of the vertical slots 42 and the horizontal slot 52 are not visible in this view because they are filled by the connector's first and second portions 24 and 26, respectively. FIG. 7 also shows that the connector's second portion 26 lies flush against the base lower surface 40.

FIGS. 8–11 show the switch embodiment of an extension wire socket 210. In this embodiment, each of the extension wires 16 is attached to a respective end of a switch 292. The socket 210 includes a socket housing 218 which is similar to the socket housing 18 in the previously disclosed embodiment, except for the addition of a separating tab, shown in FIGS. 9–11. Connector 220 is similar to connector 22 shown in FIG. 4, and thus includes a first portion 224, a second portion 226 and a spiked prong 258. The switch embodiment, however, does not employ two identical connectors. Instead, connector 222 is a mirror image of the connector 220.

Figure 9:
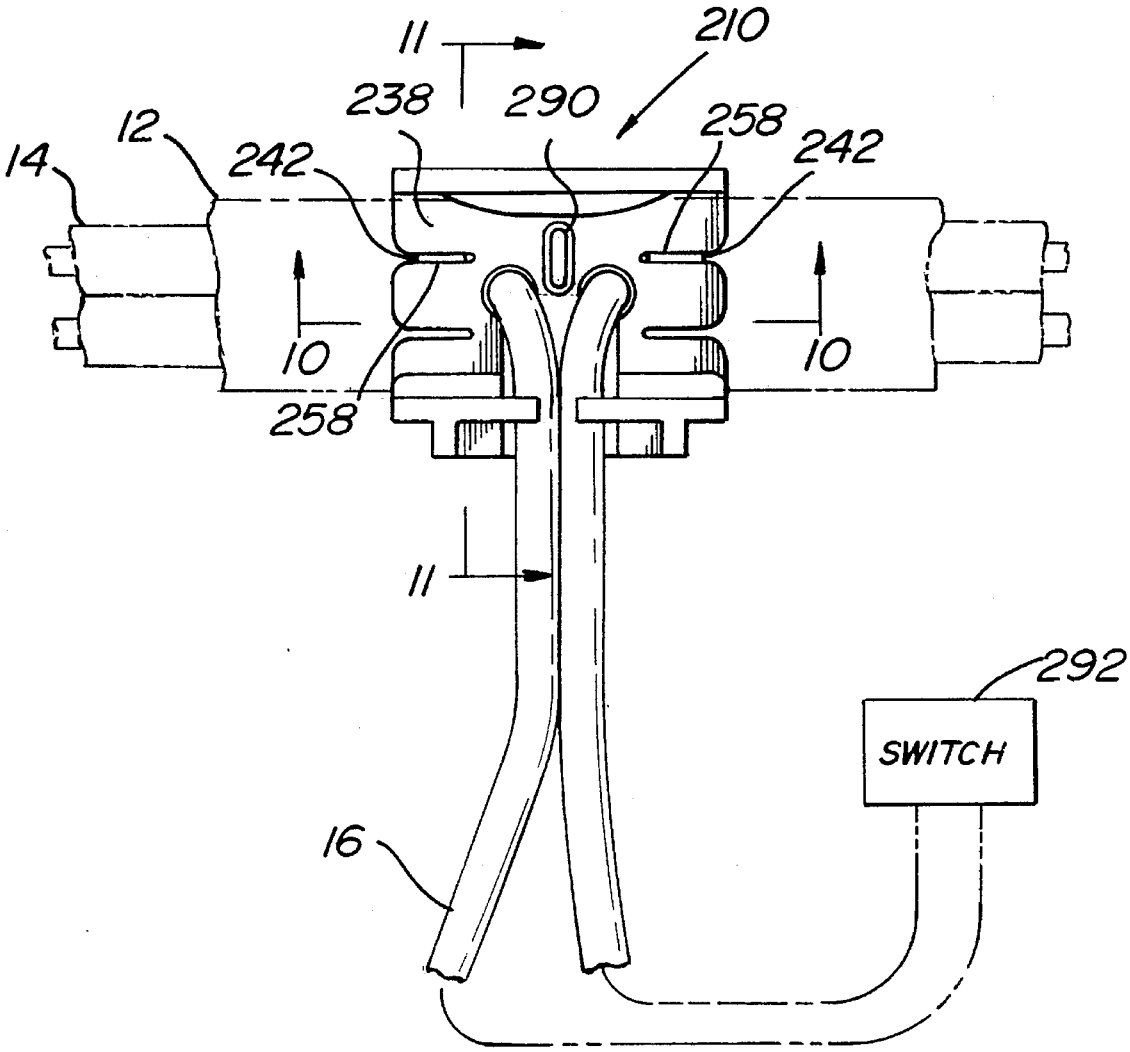
FIG. 9 is a bottom view of the socket in FIG. 8, showing the channel and electrical conductors in phantom.

FIG. 9 is a bottom view of the socket 210 and shows the channel 12 and the electrical conductors 14 in phantom. Two of the four vertical slots 242 are occupied by connectors. Upper right hand vertical slot 242 holds connector 220 and upper left hand vertical slot 242 holds connector 222. The spiked prongs 258 of those connectors are visible in this view.

FIG. 9 also shows nonconductive separating tab 290 disposed about midway between the vertical slots 242. The separating tab 290 extends outward from the base upper surface 238.

Figure 10:
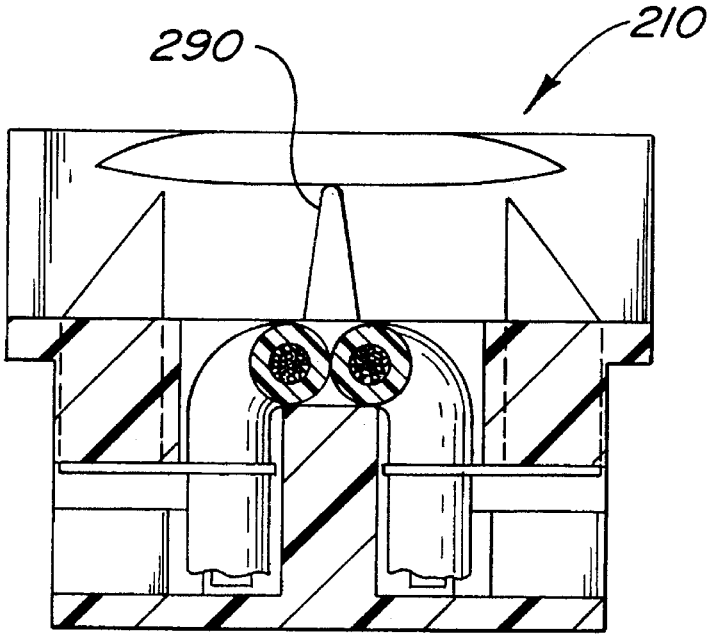
FIG. 10 is a sectional view of the socket in FIG. 8, taken along line 10—10 in FIG. 9.

FIG. 10 is a sectional view of the socket 210, taken along line 10—10 in FIG. 9. This view more clearly the separating tab 290.

Figure 11:
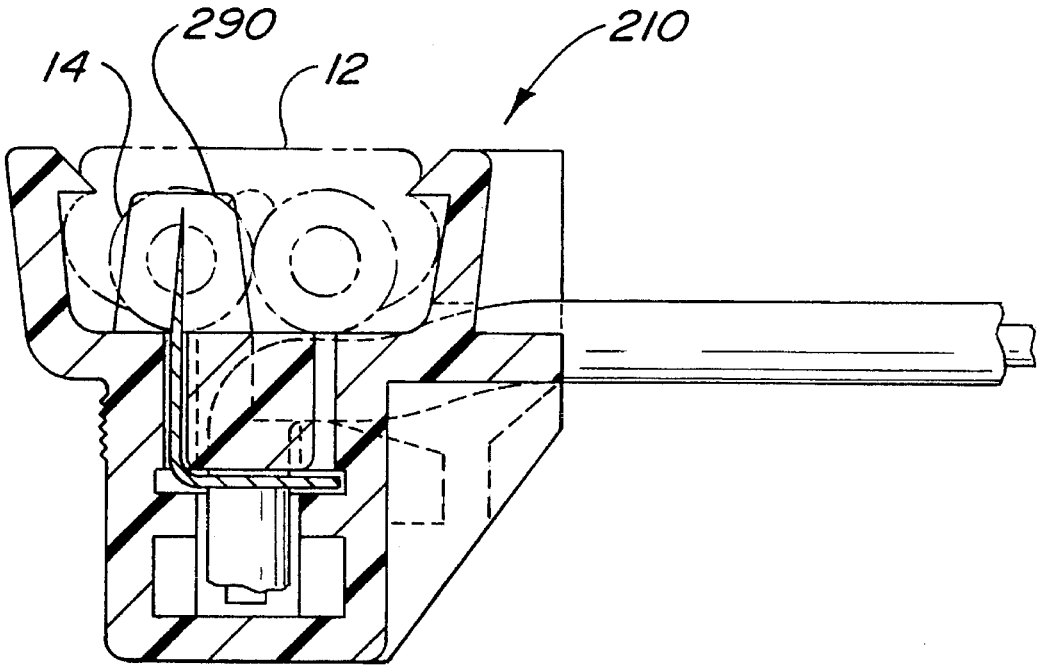
FIG. 11 is sectional view of the socket in FIG. 8, taken along line 11—11 of FIG. 9, also showing the channel and electrical conductors in phantom.

FIG. 11 is sectional view of the socket 210, taken along line 11—11 of FIG. 9. The channel 12, electrical conductors 14 and separating tab 290 are shown in phantom.

The socket 210 is attached to an electrical conductor/channel subassembly in the same manner as the socket 10. However, before the attachment, one of the conductors is physically slit perpendicular to its longitudinal axis. The socket 210 is then aligned with the electrical conductor/channel subassembly so that the separating tab 290 meets the slit. As the socket 210 is attached to the subassembly, the separating tab 290 pushes into the slit, thereby ensuring that the cut ends of the conductor do not touch each other.

Figure 12A:
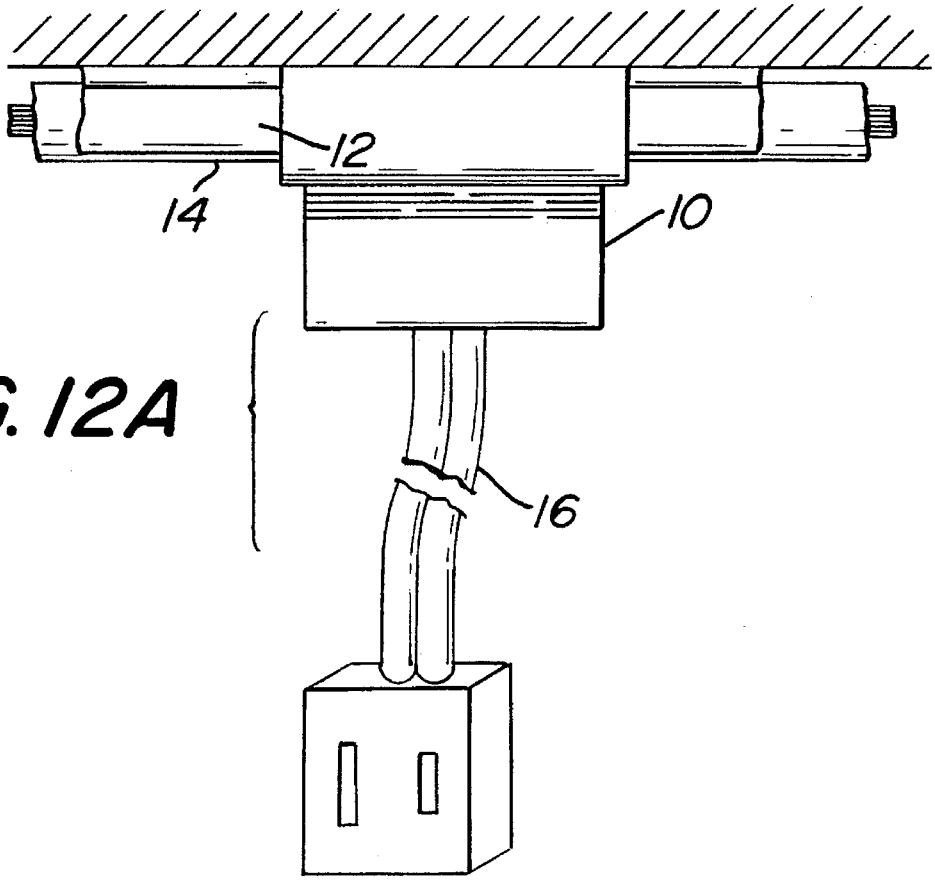
FIG. 12A is a diagrammatical view of the socket in FIGS. 3–7 functioning as a wire extension device for a single plug-in outlet.
Figure 12B:
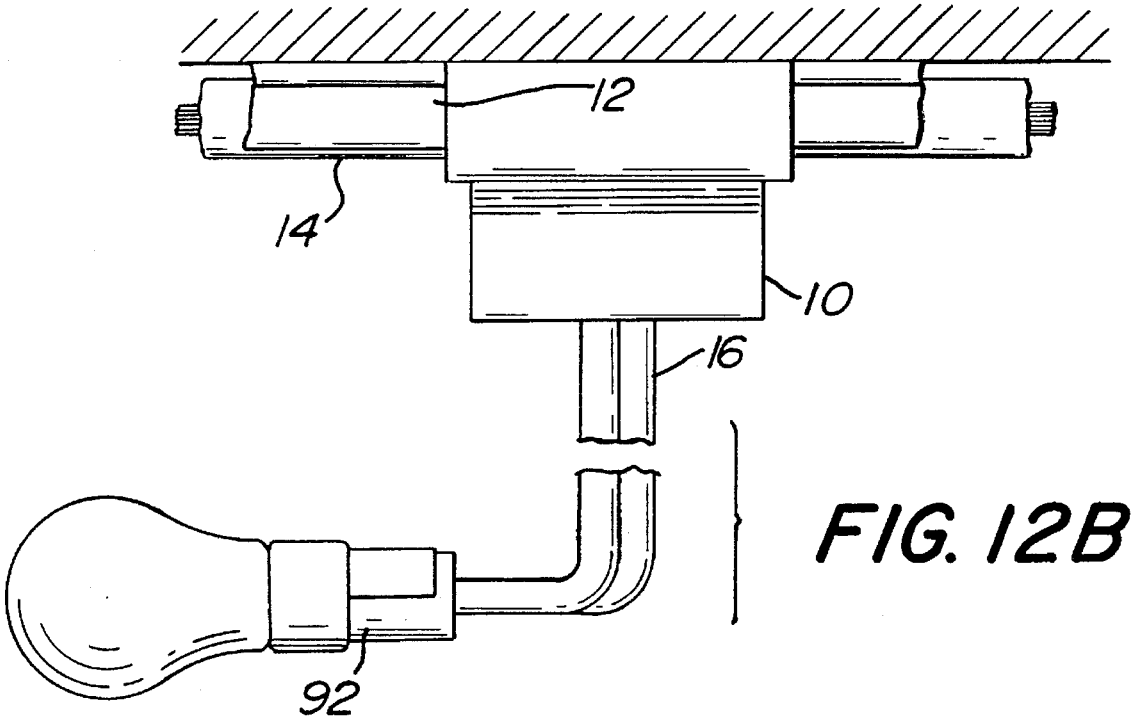
FIG. 12B is a diagrammatical view of the socket in FIGS. 3–7 functioning as a direct wire connection device for an electrical appliance.

FIGS. 12A is a diagrammatical view of how the novel socket 10 shown in FIGS. 3–7 functions as a wire extension device for a plug-in outlet. FIGS. 12B is a diagrammatical view of how the novel socket 10 shown in FIGS. 3–7 functions as a direct wire connection device for an electrical appliance such as a light bulb.

In FIG. 12A, each of the socket wires 16 are electrically connected to respective hot and ground sides of a single plug-in outlet. The arrangement shown in FIG. 12A is ideally suited to connect plug-in type portable or tabletop low-voltage fixtures or appliances to a low-voltage power bus (i.e., electrical conductors 14).

In FIG. 12B, each of the socket wires 16 are electrically connected directly to a respective hot and ground side of a lamp socket 92. The arrangement shown in FIG. 12B is ideally suited to connect low-voltage lighting fixtures to a low-voltage power bus (i.e., electrical conductors 14).

The novel socket housing 18 (218) described herein has numerous advantages over prior art snap-on sockets. In the novel socket 10 (210), the only portion of the electrical connector which is exposed prior to attachment to a conductor/channel subassembly is the spiked prong portion. All other parts of the electrical connector lie within either slots in the housing 18 (218) or in the chamber. The slots protect those connector portions from unwanted flexing and movement as the connector is handled and/or snapped onto the conductor/channel subassembly. In contrast, the base portion and the spiked prong of the connector in the prior art connector assembly shown in FIGS. 1 and 2 are both openly exposed and not supported by the assembly housing, thereby increasing the likelihood that the integrity of the connector will be damaged from unwanted flexing and movement. This potentially weakens the overall strength of the prior art connector and reduces the ability of that connector to remain firmly in position within its assembly during and after attachment to conductor/channel subassembly.

Furthermore, the extension wires 16 in the novel socket housing 18 (218) are attached by insulation displacement to electrical connectors inside a chamber spaced away from the base upper surface. In contrast, the wiring attached to the prior art connector assembly shown in FIGS. 1 and 2 is attached by insulation displacement to electrical connectors in regions which are partly exposed to the base upper surface, thereby increasing the likelihood of damaging the integrity of the attachment.

The novel socket housing 18 (218) allows extension wires 16 to be fully inserted and held into position in the housing 18 (218) before the connectors are attached thereto. This simplifies socket assembly because the wires 16 do not need to be held in position by a tool while the connector insulation displacement terminals are pushed into the extension wires 16. The novel socket housing 18 (218) also allows all portions of the extension wires 16 which enter the housing 18 (218) to impress into the base upper surface so that the wires 16 are not crushed when the socket 10 (210) is attached to the conductor/channel subassembly.

The type of materials employed to construct the novel socket 10 (210) will depend upon the particular application. The housing 18 (218) may be constructed of any rigid nonconducting material. One suitable type of material is molded polycarbonate. One suitable material for the channel 12 is a resin sold under the trademark Noryl®.

The present invention may be embodied in other specific forms without departing from the spirit or essential attributes thereof and, accordingly, reference should be made to the appended claims, rather than to the foregoing specification, as indicating the scope of the invention.

We claim:

1. An extension wire socket for attachment to insulated electrical conductors, the socket accepting at least one terminal end of at least one extension wire, the socket comprising:

(a) a nonconductive housing including (i) a U-shaped portion defined by a base and opposed tabs extending from the base, the base having an upper surface facing the conductors and a lower surface, the U-shaped portion being dimensioned to surround the conductors, and (ii) a chamber adjacent to the base of the U-shaped portion, the chamber including ribs extending therein for forming a slot between the ribs and the base lower surface, and (b) at least one electrical connector supported by the housing for electrically connecting the terminal end of the extension wire to one of the conductors, each connector including (i) a first portion having a spiked prong associated therewith for piercing the insulation of one of said conductors when the socket is attached to the conductors and making conductive contact with the conductor, the spiked prong being located in the U-shaped portion, and (ii) a second portion attached to the first portion and being located in the chamber, flush against the base lower surface and fitting into the slot, the second portion having an insulation displacement terminal associated therewith for attachment to the terminal end of the extension wire, the insulation displacement terminal being located in the chamber.

2. An extension wire socket according to claim 1 wherein the housing base includes at least one slot formed therein for accepting a part of the first portion of the electrical connector.

3. An extension wire socket according to claim 1 wherein the base of the housing includes at least one opening formed therethrough for allowing the terminal end of the extension wire to pass through the U-shaped portion and into the chamber.

4. An extension wire socket according to claim 1 wherein the housing chamber is open on at least one end to allow it to receive the second portion of the electrical connector.

5. An extension wire socket according to claim 1 wherein the socket attaches to a channel which holds the electrical conductors, the U-shaped housing portion dimensioned to allow the tabs to attach to the channel.

6. An extension wire socket according to claim 1 wherein the insulation displacement terminal is a cut-out in a distal end of the second portion.

7. An extension wire socket according to claim 1 wherein the socket includes two electrical connectors and accepts terminal ends of a pair of extension wires, each connector connecting one of the pair of extension wires to one of said conductors.

8. An extension wire socket according to claim 7 wherein the electrical connectors connect each of the pair of extension wires to a different one of said conductors.

9. An extension wire socket according to claim 7 wherein the electrical connectors connect each of the pair of extension wires to the same one of said conductors.

10. An extension wire socket according to claim 1 wherein the electrical connector is L-shaped, one side of the L being associated with the first portion, the other side of the L being associated with the second portion.

11. An extension wire socket according to claim 10 wherein the spiked prong is at a distal end of the first portion and the insulation displacement terminal is at a distal end of the second portion.

12. An extension wire socket according to claim 1 wherein the chamber includes a wall for dividing the chamber longitudinally into two electrically isolated parts, each part associated with one extension wire.

13. An extension wire socket according to claim 12 wherein the base of the housing further includes at least one opening formed therethrough for allowing the terminal end of the extension wire to pass through the U-shaped portion and into the chamber, the opening being generally aligned with an edge of the wall.

* * * * *